US010639771B2

(12) United States Patent
Forsberg et al.

(10) Patent No.: US 10,639,771 B2
(45) Date of Patent: May 5, 2020

(54) POWER TOOL WITH OUTPUT TORQUE COMPENSATION AND METHOD THEREFOR

(71) Applicant: ATLAS COPCO INDUSTRIAL TECHNIQUE AB, Stockholm (SE)

(72) Inventors: Per Ingemar Forsberg, Värmdö (SE); Klas Erik Sundberg, Nacka (SE)

(73) Assignee: ATLAS COPCO INDUSTRIAL TECHNIQUE AB, Stockholm (SE)

( * ) Notice: Subject to any disclaimer, the term of this patent is extended or adjusted under 35 U.S.C. 154(b) by 239 days.

(21) Appl. No.: 15/563,886

(22) PCT Filed: Mar. 30, 2016

(86) PCT No.: PCT/EP2016/056908

§ 371 (c)(1),
(2) Date: Oct. 2, 2017

(87) PCT Pub. No.: WO2016/156388

PCT Pub. Date: Oct. 6, 2016

(65) Prior Publication Data

US 2018/0117746 A1 May 3, 2018

(30) Foreign Application Priority Data

Apr. 2, 2015 (SE) ..... 1550400

(51) Int. Cl.
*B25B 23/147* (2006.01)
*B25B 21/00* (2006.01)
*B25F 5/00* (2006.01)

(52) U.S. Cl.
CPC ..... *B25B 23/147* (2013.01); *B25B 21/00* (2013.01); *B25F 5/00* (2013.01); *B25F 5/001* (2013.01)

(58) Field of Classification Search
CPC ... B25B 23/147; B25B 21/00; B25B 23/1422; B25B 23/1425; B25F 5/00; B25F 5/001; B25D 11/10; B25D 16/00
(Continued)

(56) References Cited

U.S. PATENT DOCUMENTS 5,458,207 A * 10/1995 Mattero ..... E21B 44/00 173/6
5,637,968 A * 6/1997 Kainec ..... B23P 19/066 173/5

(Continued)

FOREIGN PATENT DOCUMENTS

WO 2010142318 A1 12/2010
WO 2011152136 A1 12/2011

(Continued)

OTHER PUBLICATIONS

International Search Report (ISR), Written Opinion and International Preliminary Report on Patentability (IPRP) dated Jun. 8, 2016 issued in International Application No. PCT/EP2016/056908.

*Primary Examiner* — Chelsea E Stinson
*Assistant Examiner* — Himchan "Aiden" Song
(74) *Attorney, Agent, or Firm* — Holtz, Holtz & Volek PC

(57) ABSTRACT

A torque delivering power tool includes a power line driven by a motor. The power line includes an input part with an input shaft, an output part with an output shaft, and at least one gear. The input shaft is drivingly connected to the output shaft via the gear. A motor shaft is drivingly connected to the input shaft via a reduction gearing. A torque meter monitors a torque acting in at least one point along the power line, an angle meter monitors an angular rotation in the power line, and an index meter monitors absolute angular positions of the input shaft or the output shaft. A control unit receives information from the angle meter, torque meter and index meter, and controls a torque output of the motor according (Continued)

to a mapping function corresponding to an angular index position dependent torque transmission over the power line.

17 Claims, 3 Drawing Sheets

(58) Field of Classification Search
USPC ..... 173/2, 170, 176, 183, 5, 6; 81/479
See application file for complete search history.

(56) References Cited

U.S. PATENT DOCUMENTS

| | | | | |
|---|---|---|---|---|
| 6,843,326 | B2 * | 1/2005 | Tambini | G01D 5/34738 173/1 |
| 7,958,944 | B2 * | 6/2011 | Lehnert | B25B 23/1405 173/1 |
| 9,874,493 | B2 * | 1/2018 | Brandstrom | F16H 57/01 |
| 2005/0109519 | A1 * | 5/2005 | Kawai | B25B 21/026 173/183 |
| 2006/0218768 | A1 * | 10/2006 | Makimae | B23P 19/066 29/407.03 |
| 2013/0037288 | A1 * | 2/2013 | Schell | B25F 5/001 173/1 |
| 2013/0062086 | A1 * | 3/2013 | Ito | B25B 23/1405 173/1 |
| 2015/0177098 | A1 * | 6/2015 | Brandstrom | F16H 57/01 702/41 |
| 2019/0310156 | A1 * | 10/2019 | Kleza | G01L 25/003 |

FOREIGN PATENT DOCUMENTS

| | | | | |
|---|---|---|---|---|
| WO | 2014000772 | A1 | 1/2014 | |
| WO | WO-2014000772 | A1 * | 1/2014 | F16H 57/01 |

* cited by examiner

POWER TOOL WITH OUTPUT TORQUE COMPENSATION AND METHOD THEREFOR

The invention relates to a torque delivering power tool in which the output torque is compensated for variations in the torque transfer along the power line inside the power tool. The invention also relates to a method of compensating the output torque in such a power tool.

BACKGROUND

In industrial use of torque delivering power tools such as power wrenches and nutrunners that are used for tightening joints it is important to monitor the applied torque in order to verify that the joints are fastened to a satisfactory degree. It is often desired to install a predetermined clamp force into a joint. Normally it is however difficult to monitor the clamp force and it is therefore common practice to instead control a tightening so as to install a specific target torque in a joint.

A difficulty related to the monitoring of a delivered torque is that there are losses due to friction in the joint and due to gear ripple and the like inside the tool that affects the accuracy of the monitoring values in an unpredictable manner. The friction in a joint may vary largely between different joints, but it may be presumed to be constant for a specific joint at specific conditions, and there are manners of estimating the friction for a specific joint, both by empiric testing or by real time monitoring during the tightening of a joint.

The variations that are due to gear ripple and the like inside the tool are more difficult to predict. One way of eliminating these problems is to locate a torque meter as close to the joint as possible, i.e. on the output shaft. There is however a conflicting desire to minimize the size of the power tool in general and specifically to minimize the number of delicate components in the vicinity of the output shaft.

Hence, there is a need of a torque delivering power tool which is adapted to deliver a precise output torque but which does not involve a lot of delicate components in the vicinity of the output shaft.

SUMMARY OF THE INVENTION

An object of the invention is to provide a torque delivering power tool in which the output torque and a method for delivering a precise output torque with less variations due to gear ripple and the like. This object is achieved by the invention according to a first and a second aspect.

According to a first aspect the invention relates to a torque delivering power tool comprising:

- a power line driven by a motor, the power line including an input shaft that is drivingly connected to an output shaft via at least one gear,
- a torque meter for monitoring the torque acting in at least one point along the power line,
- an angle meter for monitoring an angular rotation in the power line. The torque delivering power tool further comprises an index meter for monitoring an absolute angular position of either the input shaft or the output shaft, wherein a control unit is arranged to receive information from the angle meter, torque meter, and index meter and to control the motor in accordance with a mapping function corresponding to a torque transmission over the at least one gear of the power line.

By controlling the motor in accordance with a mapping function corresponding to a torque transmission over the at least one gear of the power line the output torque is compensated, such that its variations due to gear ripple and the like is compensated for and a more precise output torque is achieved.

In a specific embodiment of the inventive torque delivering power tool the angle meter is comprised in the motor, monitoring an angular rotation of a motor shaft directly driven by the motor.

In another specific embodiment of the inventive torque delivering power tool the torque meter is comprised in the motor monitoring the torque acting in an input side of the power line.

In yet another embodiment of the inventive torque delivering power tool an auxiliary index meter is arranged, such that an index meter is arranged at both the input shaft and the output shaft, wherein the absolute angular position of the input shaft and the absolute angular position of the output shaft are monitored.

According to a second aspect the invention relates to a method in a torque delivering power tool (10) for compensating a torque output for a gear ripple over a power line including an input shaft, an output shaft and at least one gear arranged between the input shaft and the output shaft, the method comprising the steps of:

- driving an input shaft by a motor, the input shaft being drivingly connected to an output shaft over a power line including at least one gear,
- monitoring an angular rotation of either the input shaft or the output shaft,
- monitoring an angular index position of either the motor shaft or the output shaft so as to obtain an absolute angle of said shaft,
- compensating a torque output of the motor for a mapping function corresponding to an angular index position dependent torque transmission over the power line, in order to deliver an output torque from the output shaft that is compensated for angular variation of the torque transmission over the power line.

In a specific embodiment of the inventive method the step of monitoring an angular index position comprises the sub-steps of monitoring an angular index position of both the input shaft and the output shaft.

Other features and advantages of the invention will be apparent from the figures and from the detailed description of the shown embodiment.

SHORT DESCRIPTION OF THE DRAWINGS

In the following detailed description reference is made to the accompanying drawings, of which:

DETAILED DESCRIPTION OF THE SHOWN EMBODIMENT OF THE INVENTION

Figure 1:
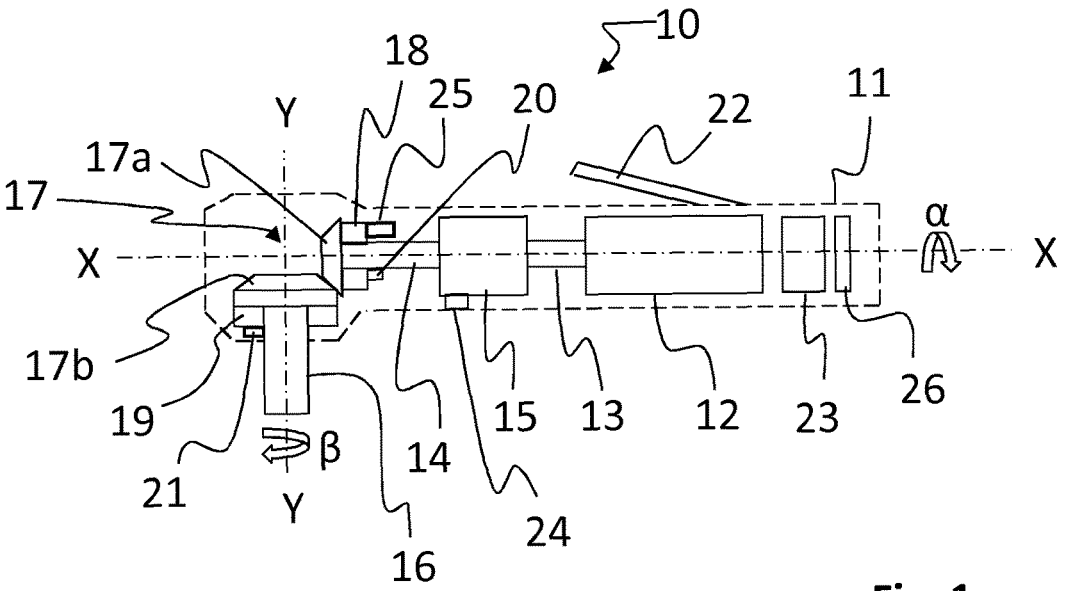
FIG. 1 is a schematic view of a torque delivering power tool according to a specific embodiment of the invention.

In FIG. 1 a torque delivering power tool 10 according to a specific embodiment of the invention is schematically shown.

The power tool 10 includes a housing 11, which encloses a motor 12 that drives a motor shaft 13. A trigger 22 is arranged to govern the function of the motor 12. The motor 12 is arranged to drive an output shaft via a power line. The power line includes an input part and an output part, which are separated by a gear 17. In the embodiment shown in FIG. 1 the input part 14 includes an input shaft and the output part includes an output shaft 16.

The motor shaft 13 is drivingly connected to an input shaft 14, via a reduction gearing 15. The reduction gearing 15 may typically be a planetary gear. In a specific embodiment the reduction gearing 15 may be omitted such that the motor shaft 13 is directly connected to the input shaft 14.

As indicated above the input shaft 14 is connected to an output shaft 16 via a gear 17. In the shown embodiment the gear 17 is an angle gear. The gear may however also be an off-set gear, a planet gear, or even a crow foot. Typically, the gear may be anything that connects an input part to an output part. The gear 17 of the shown embodiment comprises an input bevel gear 17*a*, which is an end part of the input shaft and an output bevel gear 17*b*, which is an end part of the output shaft 16. The input shaft 14 is journalled in bearings 18 and the output shaft 16 is journalled in bearings 19. In the shown embodiment two index meters are arranged to monitor the absolute angular position of the input shaft 14 and the output shaft 16. An input index meter 20 is arranged to monitor the absolute angular position of the input shaft 14 and an output index meter 21 is arranged to monitor the absolute angular position of the output shaft 16.

The power tool further comprises a control unit 23, which inter alia is arranged to control the power output of the motor 12. The monitoring of the absolute angular positions of the input and output shafts 14 and 16, respectively, are provided to the control unit 23 and taken into account for the controlling of the power output.

A torque meter 24 is arranged to monitor the torque along the power line from the motor to the output shaft. In the shown embodiment the torque meter 24 is arranged to measure the torque between the reduction gearing 15 and the housing 11. The torque meter 24 is arranged in the input part of the power line to monitor the torque acting in the input part of the power line. The torque meter 24 may be an integral part of the motor. The torque meter 24 is connected to the control unit 23 for allowing the motor to be controlled by the control unit 23 in response to the monitored torque.

In addition to the index meters 20 and 21, an angle meter 25 is arranged to monitor the rotation of at least one of the input shaft 14 and the output shaft 16. In the shown embodiment the angle meter 25 is arranged to monitor the rotation of the input shaft 14. This is advantageous as it does not imply any space demanding instruments close to the output shaft 16.

A general idea of the invention is to compensate the motor output for known inherit gear ripples and/or asymmetric gear revolutions. This may be done in that data describing the natural variation of the torque transfer over the power line is stored in a memory unit 26 that is connected to the control unit.

In the simplest embodiment of the invention the power tool comprises one torque meter 24, one angle meter 25 and one index meter 20 or 21.

In a method according to the invention of the simplest embodiment the following steps are comprised:

- driving an input shaft by a motor, the input shaft being drivingly connected to an output shaft over a power line including at least one gear 17,
- monitoring an angular rotation of either the input shaft 14 or the output shaft 16,
- monitoring an angular index position of either the input shaft 14 or the output shaft 16 so as to obtain an absolute angle of said shaft,
- compensating a torque output of the motor in accordance with a mapping function corresponding to an angular index position dependent torque transmission over the power line, in order to compensate an output torque from the output shaft for angular variation of torque transmission over the power line.

By means of this method it is possible to deliver a more precise and a more accurate torque output. In a specific embodiment both the angle meter and the index meter are arranged to continuously monitor the rotation and position of the input shaft 14. In such an embodiment the control unit 23 of the power tool will continuously be updated on the absolute position $\alpha$ of the input shaft 14. A mapping function is stored in the memory unit 26 reflecting the natural variation of the torque transfer over the power line due to irregularities on the input bevel bear 17*a*. Typically, the torque transfer varies in dependency of the inherit gear ripple and an asymmetry or non-concentricity of the input bevel gear 17*a*. The gear ripple produces a periodic curve for each tooth on the gear. Any asymmetry or non-concentricity of the gear will produce a periodic variation of the torque transfer that will repeat itself for each revolution of the input bevel bear 17*a*.

It is possible to plot the output torque $T_{out}$ as a function of the input torque $T_{in}$ and of the angular position $\alpha$ of the input bevel gear. This dependency may be made for several different torque levels to monitor if there is also a dependency on the torque level.

Figure 2:
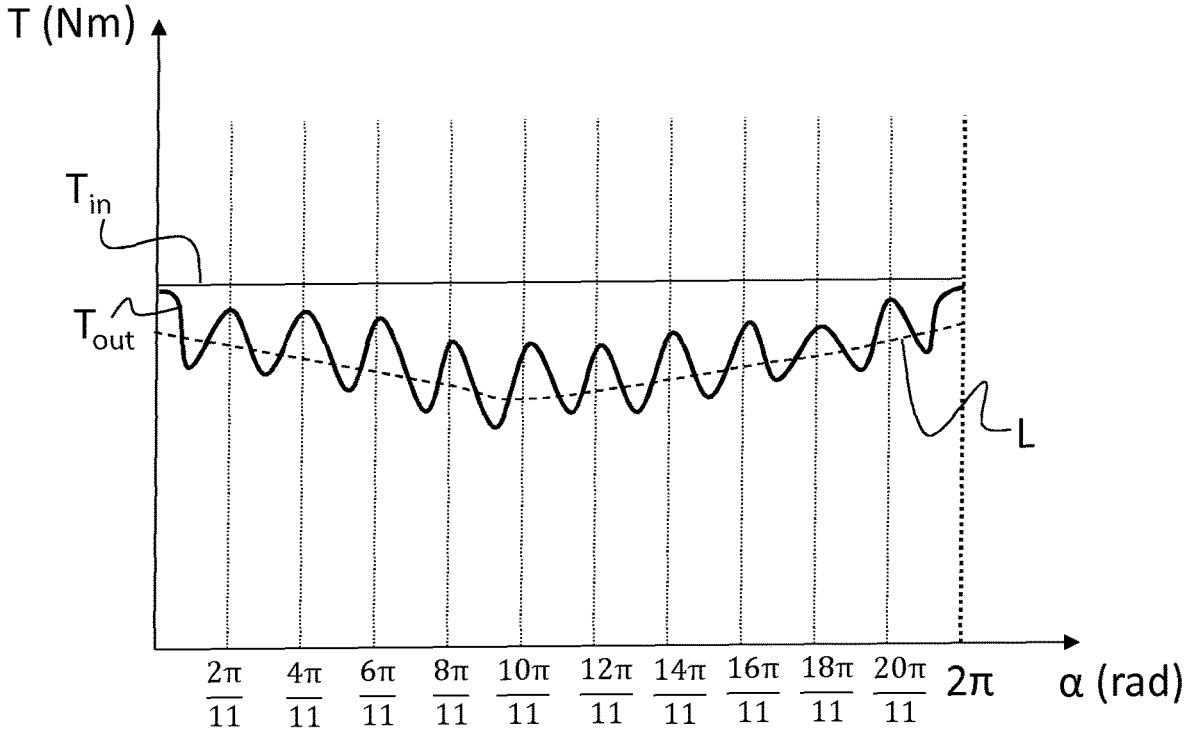
FIG. 2 is a diagram showing a typical dependency of the output torque from a constant input torque over a full rotation of a gear.

FIG. 2 shows a diagram of the torque T as a function of the angular position $\alpha$ of the input bevel gear 17*a*. A typical plot of the output torque $T_{out}$ as a function of a constant input torque $T_{in}$ is schematically shown. In a typical embodiment the input bevel gear 17*a* has eleven teeth. As a consequence, as is apparent in the plot, the output torque $T_{out}$ has the shape of a wave with 11 crests and 11 troughs. The crests correspond to points where the input bevel gear 17*a* has a good contact with the output bevel gear 17*b*, and the troughs correspond to points where the input bevel gear 17*a* has a somewhat worse contact with the output bevel gear 17*b*. In addition to this variation corresponding to the gear ripple there may also be a general trend in the curve depending on the asymmetry or non-concentricity of the input bevel gear 17*a*. This general trend is indicated in FIG. 2 by the dotted line L.

Figure 3:
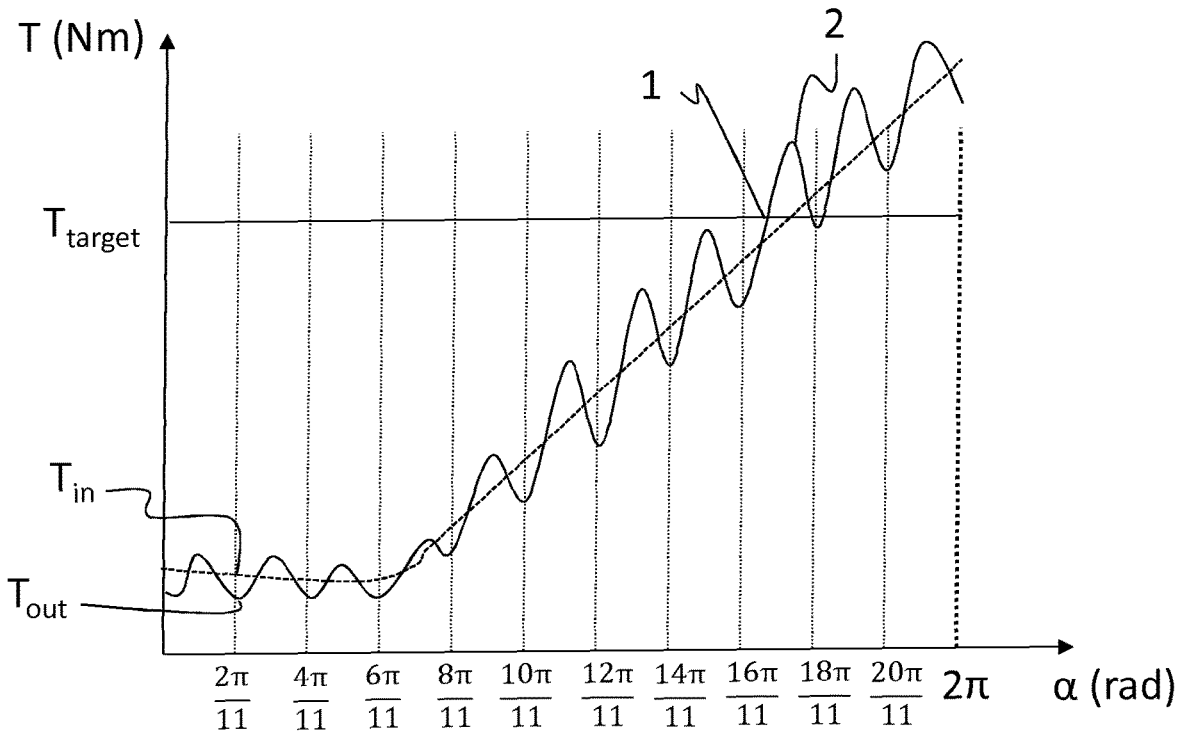
FIG. 3 is a diagram showing the output torque as a function of an increasing input torque close to a target torque.

FIG. 3 is a very schematic illustration of an output torque $T_{out}$ as a function of the angular position $\alpha$ of the input shaft 14. In the illustration in FIG. 3 the output torque $T_{out}$ is been centered around the input torque $T_{in}$. In a conventional power wrench where the motor is controlled on basis of signals from a torque meter arranged on input shaft, coupled to the output shaft via a gear, the tightening operation would be concluded at point 2, at which point the torque meter indicates that the target torque $T_{target}$ has been met. However, as is exaggeratedly indicated in FIG. 3, the actual torque level at point 2 is well over the desired target torque $T_{target}$.

Based on the mapping function describing the torque transmission over the power line as a function of the angular position α of the input shaft 14 the tightening operation may be concluded at a point 1 where the delivered torque more closely corresponds to the desired target torque $T_{target}$.

In a more sophisticated version of the invention the mapping function is not only based on the angular position α of the input shaft 14, but also on the angular position β of the output shaft 16. This is described below with reference to a second embodiment of the invention. In the second embodiment the control unit 23 is arranged to control the motor 12 in a manner that compensates for variation of the torque transmission over the power line as a function of the angular position α and/or β of the input shaft 14 and/or the output shaft 16.

As an alternative to the compensation described in relation to FIG. 3 the dependency shown in FIG. 2 may also be compensated for by varying the input torque $T_{in}$ in a corresponding degree so as to achieve an output torque $T_{out}$ that is substantially constant or at least less prone to variation. This is achieved in that a compensation curve or compensation table is stored in the memory unit 26 and that the control unit 23 governs the motor 12 as a function of the desired output torque $T_{out}$ and the angular position α of the input shaft 14.

To achieve this compensation the control unit 23 needs to receive data corresponding the current absolute angular of the input bevel gear 17*a* or the integrated input shaft 14. In one embodiment the power tool 10 includes an angle meter that monitors the angular position α of the input shaft 14 at all times, i.e. even when the power tool is at rest. With such an angle meter the absolute position of the input shaft 14 will be known directly when the tool is turned on. Such a solution will of course need to involve a continuous power source, such as a back-up battery, that powers the angle meter even when the tool is shut off. Most angle meters are however arranged to simply monitor angular movement of the shaft on which it is arranged and are not arranged to keep track of an absolute angular position of said shaft. Such an angle meter will hence not provide any information on the absolute angular position of the shaft. Therefore the power tool will need to be provided with an index meter that is arranged to keep track on the angular position of the shaft. The index meter 20 may be an integral part of the angle meter 25 or it may be arranged as a separate part. The angle meter 25 may also be an integrated part of the motor 12.

Figure 4:
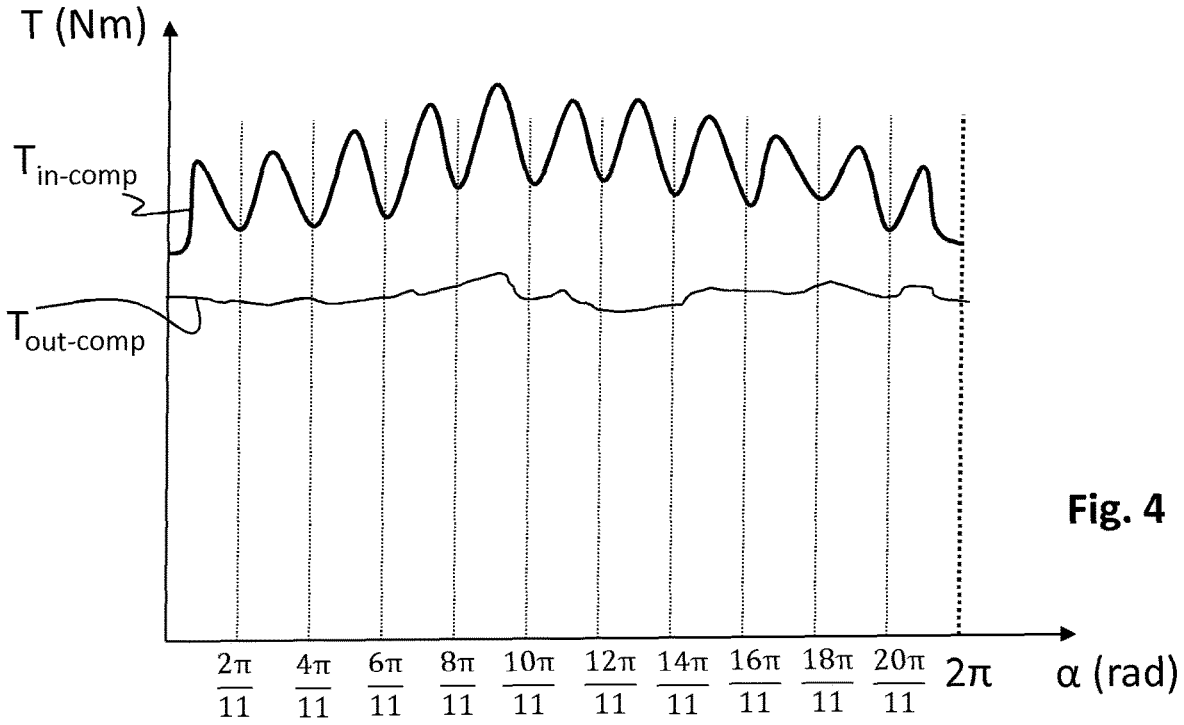
FIG. 4 is a diagram showing the output torque as a function of a compensated input torque over a full rotation of a gear.

FIG. 4 is a schematic illustration of a compensated output torque $T_{out\text{-}comp}$ as a function of the angular position α over a full rotation of the input shaft 14. In the illustration in FIG. 4 the input torque is a compensated input torque $T_{in\text{-}comp}$ adapted to provide a compensated output torque $T_{out\text{-}comp}$ that is as free from variation as possible. Theoretically, it is possible to control the output torque $T_{out}$ by means of a correspondence curve of the output torque $T_{out}$ as a function of the current provided to the motor. For a better accuracy it is however desired to have a torque meter arranged on the input part of the power line.

In the method described in relation to FIG. 3 above, the torque output $T_{out}$ is only compensated for discrepancies related to the input shaft 14. Normally, there are however also variations in the torque transmission that depend on irregularities on the output shaft 16 and the output bevel gear 17*b*. Often, the output bevel gear 17*b* has more teeth than the input bevel gear 17*a*, such that the gear 17 forms a reduction gearing. In a typical torque delivering power tool the input bevel gear 17*a* has eleven teeth and the output bevel gear 17*b* has seventeen teeth. The variations in the torque transmission that depend on irregularities on the output bevel gear 17*b* will not be compensated for in a method in relation to FIG. 3, which only takes the absolute angular position α of the input shaft 14 into account.

In a power tool where an angle meter is continuously monitoring the angular position, i.e. even when the tool is turned off, it is possible to also keep track of the rotational position of the output shaft 16 with the index meter 20 and the angle meter 25 arranged on the input shaft 14. In such an embodiment it will be possible to compensate for irregularities in the torque transmission that depend on both the input bevel gear 17*a* and the output bevel gear 17*b*. This may be done by monitoring of the torque transmission over all the possible tooth interactions, i.e. over seventeen full rotations of the input shaft 14. When the input shaft 14 has rotated 17 full laps the output shaft 16 will have rotated 11 full laps and a new cycle will commence. An exemplary diagram showing the torque output $T_{out}$ as a function of the absolute angular position α of the input shaft 14 over 17 rotations, i.e. 17*360 degrees, or 17*2π rad, is shown in FIG. 4.

As an alternative to the full time absolute angle meter a second index meter 21 may be arranged on the output shaft 16 so as to keep track of the absolute angular position β of the output shaft 16. No additional angle meter is needed, because the control unit will be able to calculate the angular position β of the output shaft 16. Further, as soon as both index meters 20 and 21 have signalled their position the control unit 23 will, by means of data retrieved from the one angle meter, be able to determine the mutual position of the input shaft 14 and the output shaft 16, and hence it will be possible to determine the absolute angular position α of the input shaft 14 along a curve corresponding to seventeen full rotations of said input shaft 14.

Figure 5:
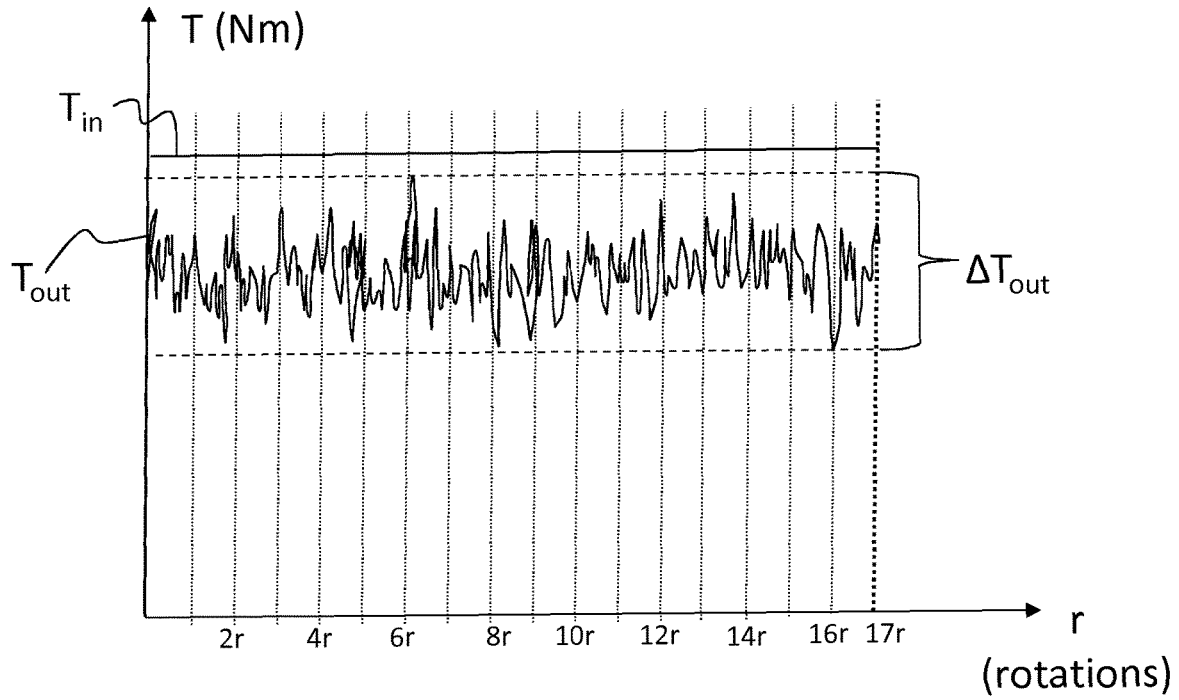
FIG. 5 is a diagram showing a typical dependency of the output torque from a constant input torque over seventeen rotations of a gear.

FIG. 5 is a diagram showing the output torque $T_{out}$ as a function of a constant input torque $T_{in}$ over 17 rotations of the input shaft, i.e. 17*2π rad. As is visible in the diagram the output torque $T_{out}$ varies substantially over the 17 rotations of the input shaft. An indication of variation of the output torque $T_{out}$ is given by a delta Torque $\Delta T_{out}$ that represents the difference between the highest and the lowest torque peaks over the 17 rotations of the input shaft.

Figure 6:
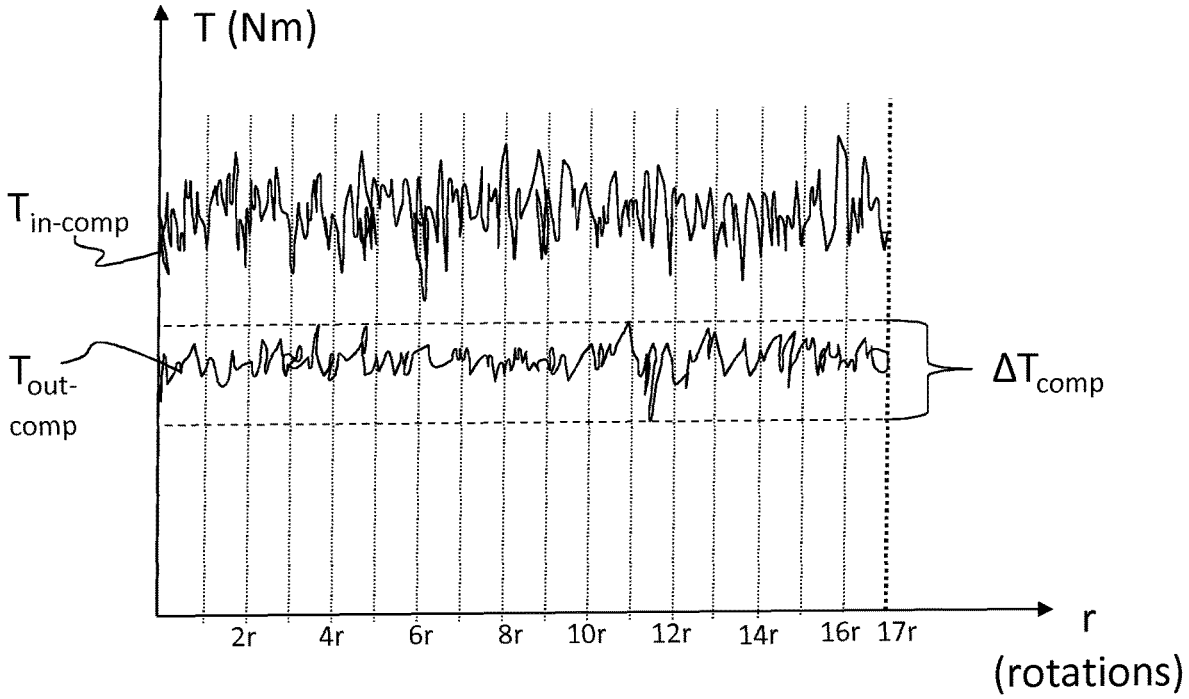
FIG. 6 is a diagram showing the output torque as a function of a compensated input torque over seventeen rotations of a gear.

In FIG. 6 a similar representation is shown for a compensated input torque $T_{in\text{-}comp}$ over 17 rotations of the input shaft. It is apparent that the compensated output torque $T_{out\text{-}comp}$ also varies over 17 rotations, but it is noticeable that the compensated delta Torque $\Delta T_{comp}$ is roughly 50% smaller than the uncompensated delta Torque $\Delta T_{out}$ shown in FIG. 4. The magnitude by which the delta Torque $\Delta T_{out}$ may be reduced is dependent on a lot of parameters, such as the accuracy of the compensated input torque $T_{in\text{-}comp}$ the accuracy of the motor, the control unit and so on. Such parameters will be easily tested and refined by a person skilled in the art. The speed of the operation is also a factor. The slower the operation is the more effective it will be to compensate the input torque $T_{in\text{-}comp}$ so as to achieve an even and reliable compensated output torque $T_{out\text{-}comp}$. In a rapid operation it may be more effective to simply monitor the output torque $T_{out}$ as a function of the mapping function.

Above, the invention has been described with reference to specific embodiments. The invention is however not limited to these embodiments. It is obvious to a person skilled in the art that the invention comprises further embodiments within its scope of protection, which is defined by the following claims.

The invention claimed is:

1. A torque delivering power tool comprising:

a power line driven by a motor, the power line comprising an input part with an input shaft, an output part with an output shaft, and at least one gear, such that the input shaft is drivingly connected to the output shaft via the at least one gear, and wherein a motor shaft is drivingly connected to the input shaft via a reduction gearing;

a torque meter which monitors a torque acting in at least one point along the power line, the torque meter being arranged along the input part of the power line;

an angle meter which monitors an angular rotation in the power line;

an index meter which monitors an absolute angular position (α) of the input shaft or an absolute angular position (β) of the output shaft; and a control unit which receives information from the angle meter, the torque meter and the index meter, and controls a torque output of the motor according to a mapping function in order to deliver an output torque from the output shaft that is compensated for angular variation of an angular-index-position-dependent torque transmission over the power line, wherein the mapping function describes the torque transmission over the power line as a function of at least one of the absolute angular position (α) of the input shaft and the absolute angular position (β) of the output shaft.

2. The torque delivering power tool according to claim 1, wherein the motor comprises the angle meter, and the angle meter monitors the angular rotation of the motor shaft directly driven by the motor.

3. The torque delivering power tool according to claim 1, wherein the motor comprises the torque meter, and the torque meter monitors the torque acting on an input side of the power line.

4. The torque delivering power tool according to claim 2, wherein the motor comprises the torque meter, and the torque meter monitors the torque acting on an input side of the power line.

5. The torque delivering power tool according to claim 1, wherein an auxiliary index meter is arranged such that index meters are arranged at both the input shaft and the output shaft, whereby the absolute angular position (α) of the input shaft and the absolute angular position (β) of the output shaft are monitored.

6. The torque delivering power tool according to claim 2, wherein an auxiliary index meter is arranged such that index meters are arranged at both the input shaft and the output shaft, whereby the absolute angular position (α) of the input shaft and the absolute angular position (β) of the output shaft are monitored.

7. The torque delivering power tool according to claim 3, wherein an auxiliary index meter is arranged such that index meters are arranged at both the input shaft and the output shaft, whereby the absolute angular position (α) of the input shaft and the absolute angular position (β) of the output shaft are monitored.

8. The torque delivering power tool according to claim 4, wherein an auxiliary index meter is arranged such that index meters are arranged at both the input shaft and the output shaft, whereby the absolute angular position (α) of the input shaft and the absolute angular position (β) of the output shaft are monitored.

9. The torque delivering power tool according to claim 1, wherein the angle meter and the index meter are integrated in one unit, and wherein a power source is arranged to continuously power said one unit, such that the absolute angular position (α) of the input shaft or the absolute angular position (β) of the output shaft is continuously monitored.

10. The torque delivering power tool according to claim 2, wherein the angle meter and the index meter are integrated in one unit, and wherein a power source is arranged to continuously power said one unit, such that the absolute angular position (α) of the input shaft or the absolute angular position (β) of the output shaft is continuously monitored.

11. The torque delivering power tool according to claim 3, wherein the angle meter and the index meter are integrated in one unit, and wherein a power source is arranged to continuously power said one unit, such that the absolute angular position (α) of the input shaft or the absolute angular position (β) of the output shaft is continuously monitored.

12. The torque delivering power tool according to claim 4, wherein the angle meter and the index meter are integrated in one unit, and wherein a power source is arranged to continuously power said one unit, such that the absolute angular position (α) of the input shaft or the absolute angular position (β) of the output shaft is continuously monitored.

13. The torque delivering power tool according to claim 1, wherein the control unit varies the torque output of the motor during each rotation of the input shaft in order to deliver the output torque from the output shaft that is compensated for the angular variation of the torque transmission over the power line.

14. The torque delivering power tool according to claim 1, wherein the index meter is provided on the input shaft or on the output shaft.

15. The torque delivering power tool according to claim 1, wherein the index meter is provided on the input shaft.

16. A method for compensating a torque output in a torque delivering power tool, said torque delivering power tool including a power line including an input shaft, an output shaft and at least one gear arranged between the input shaft and the output shaft, and a motor shaft drivingly connected to the input shaft via a reduction gearing, the method comprising:

driving the input shaft by a motor, the input shaft being drivingly connected to the output shaft over the power line including the at least one gear;

monitoring an angular rotation of at least one of the input shaft and the output shaft;

monitoring an angular index position of at least one of the input shaft and the output shaft so as to obtain at least one of an absolute angular position (α) of the input shaft and an absolute angular position (β) of the output shaft; and controlling a torque output of the motor according to a mapping function in order to deliver an output torque from the output shaft that is compensated for angular variation of an angular-index-position-dependent torque transmission over the power line, wherein the mapping function describes the torque transmission over the power line as a function of at least one of the absolute angular position (α) of the input shaft and the absolute angular position (β) of the output shaft.

17. The method according to claim 16, wherein controlling the torque output of the motor comprises varying the torque output of the motor during each rotation of the input shaft in order to deliver the output torque from the output shaft that is compensated for the angular variation of the torque transmission over the power line.

* * * * *